US005689912A

United States Patent [19]

Prestele

[11] Patent Number: 5,689,912

[45] Date of Patent: Nov. 25, 1997

[54] HONEYCOMB PLATE FOR LAWNS

[76] Inventor: Eugen Prestele, Albert-Greiner-Strasse 73, D-86161 Augsburg, Germany

[21] Appl. No.: 575,455

[22] Filed: Dec. 20, 1995

[30] Foreign Application Priority Data

Dec. 22, 1994 [DE] Germany ..... 94 20 485.3 U

[51] Int. Cl.[6] ..... A01G 9/02

[52] U.S. Cl. ..... 47/1.01; 404/36

[58] Field of Search ..... 47/1.01, 1.01 F, 47/66 S, 66 R; 404/36, 70

[56] References Cited

U.S. PATENT DOCUMENTS

| | | | |
|---|---|---|---|
| 4,111,585 | 9/1978 | Mascaro | 47/101 F |
| 4,478,901 | 10/1984 | Dickens | 404/36 |
| 4,621,942 | 11/1986 | Hill | 404/36 |
| 5,287,649 | 2/1994 | Prestele | 47/1.01 F |
| 5,467,554 | 11/1995 | Prestele | 404/36 |

*Primary Examiner*—Terry Lee Melius
*Assistant Examiner*—Joanne C. Downs
*Attorney, Agent, or Firm*—Jordan and Hamburg

[57] ABSTRACT

Honeycomb lawn plates for seeding surfaces have honeycombed chambers open at the top and hexagonal in cross-section. So that peripheral chamber walls do not really contact one another, peripherally open chambers are provided on the plate edges, the cross-section of which is less than the cross-section of the hexagonal chambers. So that stable plate edges are obtained, the cross-section of the peripherally open chambers is, at maximum, half as large as the cross-section of the hexagonal chambers. In addition, peripherally closed chambers are located between the peripherally open chambers. On opposite plate edges, the change from peripherally open chambers to peripherally closed chambers alternates, as a result of which the peripherally open chambers are sealed by the peripheral chamber walls of the peripherally closed chambers of the adjacent plate.

4 Claims, 3 Drawing Sheets

HONEYCOMB PLATE FOR LAWNS

FIELD OF THE INVENTION

The invention relates to a honeycomb plate for seeding lawns.

BACKGROUND TO THE INVENTION

Honeycomb plates for lawns usually have a honeycombed structure. If the chambers on the plate periphery are closed on the side, then peripheral chamber walls of adjacent plates abut and thus form double walls. Stones trickling in between the double walls hinder laying of the plates. Stones of this type are wedged between the double walls and in this way hinder the required thermal expansion potential of the plates made of plastic. As a result, uncontrolled stresses occur in the plates laid in position which can lead to lifting of individual plates. However, the peripheral areas are stable due to the peripherally closed chambers.

This is avoided by honeycomb lawn plates as described in European patent application EP-A-0516 957. Those plates also have honeycombed chambers, in which the plate edges cut the peripheral chambers. The peripherally cut chambers of adjacent plates form a further chamber in each case, so that the peripheral lateral walls of the chambers of the plates only come in contact with one another along their vertical edges. As as result, catching of stones and sand between adjacent plates is avoided. The disadvantage of this embodiment can be seen in that due to the fact that the chambers are open on the periphery, the peripheral areas of the plates have less stability than in the case of the aforementioned plates with peripherally closed chambers.

SUMMARY OF THE INVENTION

An object of the invention is to design the honeycomb plates for lawns in such a way that peripheral areas of the plates are stable, but that the walls of the chambers of adjacent plates do not come into real contact with one another. In accordance with an embodiment of the invention, a honeycomb lawn plate for seeding surfaces is comprised of honeycombed chambers open at their top and hexagonal in cross-section, and peripherally open chambers on at least one plate edge the cross-section of which is smaller than the cross-section of the hexagonal chambers, the cross-section of the peripherally open chambers being a maximum of half as large as the cross-section of the hexagonal chambers, peripherally closed chambers being located between peripherally open chambers and a change from peripherally open chambers to peripherally closed chambers alternates on opposite plate edges.

BRIEF DESCRIPTION OF THE DRAWINGS

An embodiment of the invention is described below, with reference to the drawings, in which.

DETAILED DESCRIPTION OF PREFERRED EMBODIMENTS

Figure 1:
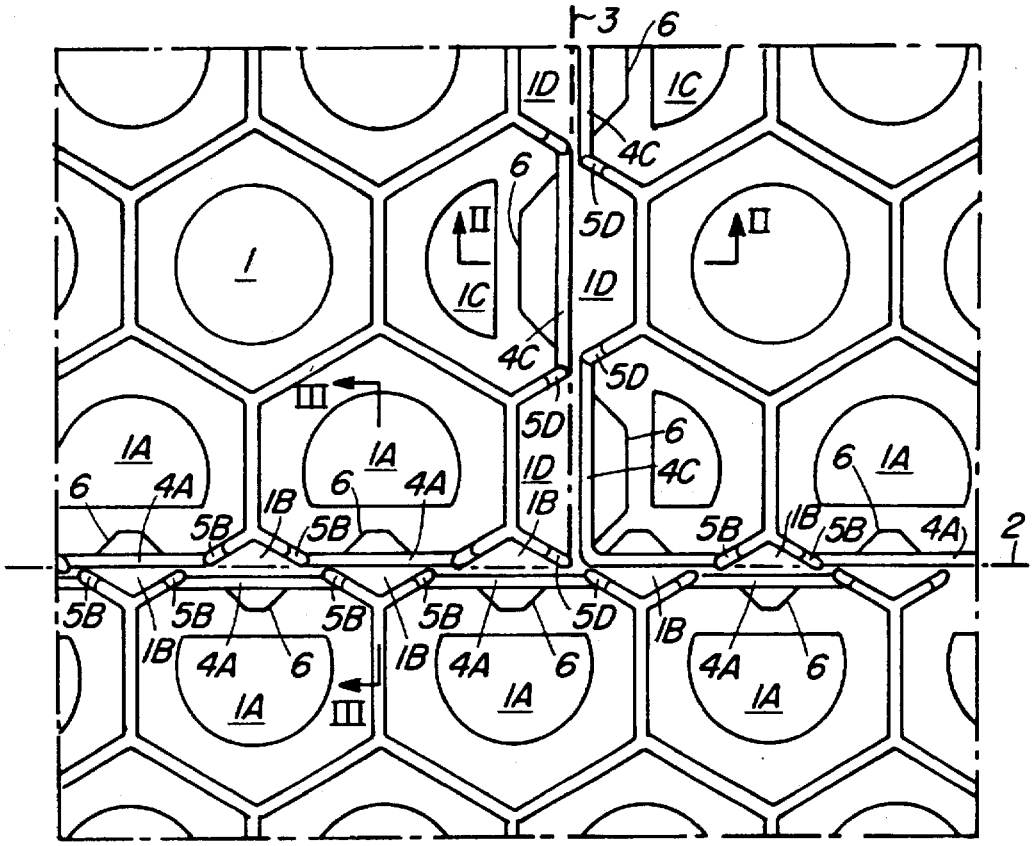
FIG. 1 is a top view onto the peripheral area of three abutting plates.

The honeycomb lawn plates have hexagonal chambers 1. These honeycomb lawn plates are defined by their plate edges 2, 3. Chambers 1A, closed on their peripheries, are provided on the edge of the plate 2, the closed chambers 1A alternating with peripherally open chambers 1B. The peripherally closed chambers each has a chamber wall 4A which extends along the plate edge 2. The closed chambers 1A thus have a heptagonal surface, while the peripherally open chambers 1B have a triangular surface. In this case, they are arranged in such a way that the peripherally closed chambers 1A of one plate are opposite the peripherally open chambers 1B of the other plate. This means that the change from closed chambers 1A to peripherally open chambers 1B alternates in a plate on opposite plate edges 2. The peripheral chamber walls 4A of the one plate thus seals the peripherally open chambers 1B of the respective other adjacent plate. Thus adjacent plates only come into linear contact with one another along the vertical edges 5B of the chamber walls of peripherally open chambers 1B.

The peripherally closed chambers 1C also have a hexagonal cross-section on the plate edge 3 which extends at right angles to plate edge 2, whereby the peripheral chamber walls 4C extend along plate edge 3. Opposite the peripherally closed chambers 1C of the one plate are the peripherally open chambers 1D of the respective other honeycomb lawn plate. The peripheral chamber walls 4C of each plate thus seals the peripheral chambers 1D of the respective adjacent lawn plate, which is in turn ensured by the alternating change from open to closed chambers along opposite plate edges 3. The chambers 1D each have a trapezoidal surface. It is also ensured in this case that with plates placed adjacent to one another, there is only a linear contact along the edges 5D of the chamber walls of peripherally open chambers 1D between the plates.

The peripherally open chambers 1B and 1D have tongues 6 projecting at the base about the plate edge 2, 3, the tongues engaging in slits 7 of the peripheral chamber walls 4A, 4C of the closed chambers 1A, 1C. The mechanical connection to plates laid adjacent to one another is thereby improved.

Figure 4:
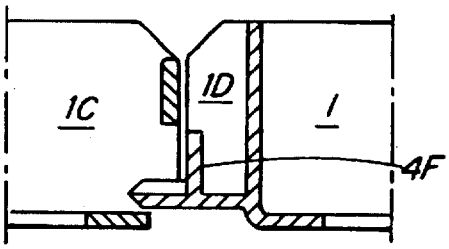
FIG. 4 is a section corresponding to FIG. 2 in a variation of the embodiment.

In the embodiment of FIG. 4, chamber wall 4C is replaced by two partial walls 4E and 4F to form a chamber wall 4D. The upper area of chamber wall 4D is thereby formed by the partial wall 4E of the closed chamber 1C and the lower area of the partial wall 4F of the open chamber 1D. In a chamber wall design of this type, divided into two, it is possible to omit chamber walls extending along the plate edges, in order to maintain the honeycombed structure there, in which the plate edge of the one plate has the upper partial walls 4E and the plate edge of the abutting plate has the lower partial walls 4F. In this embodiment, the peripheral chamber walls come to form hexagonal chambers with the remaining full chamber walls.

Figure 2:
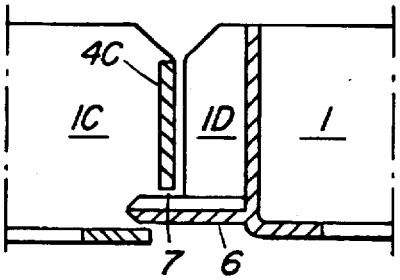
FIG. 2 is a section along line II—II in FIG. 1.
Figure 3:
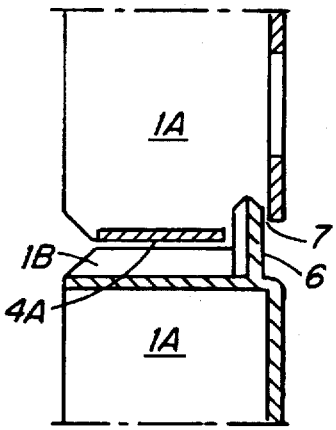
FIG. 3 is a section along line III—III in FIG. 1.
Figure 5:
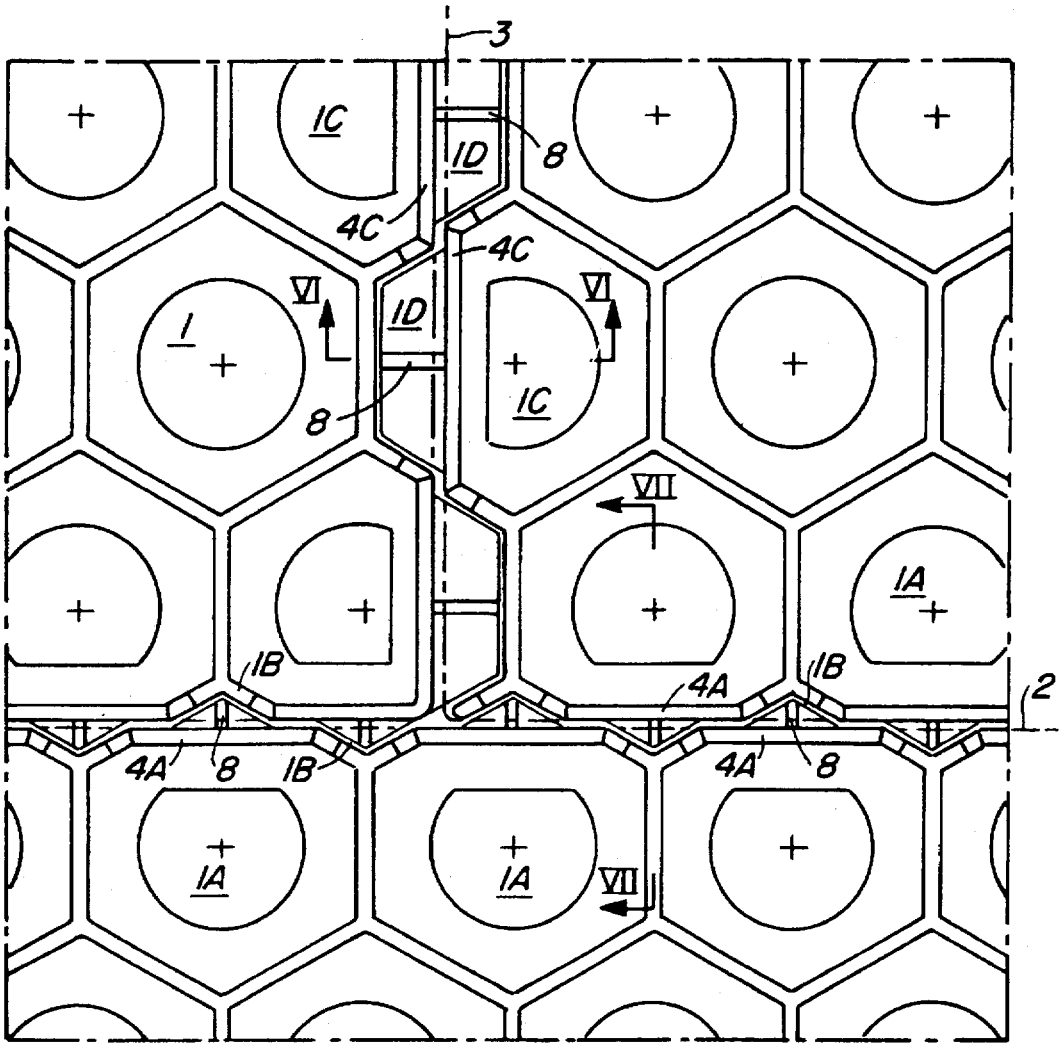
FIG. 5 is a top view corresponding to FIG. 1 in a further embodiment.
Figure 6:
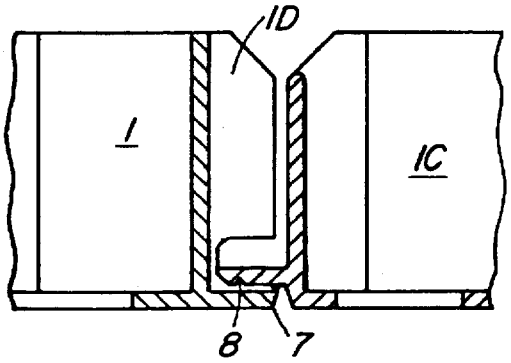
FIG. 6 is a section along the line VI—VI in FIG. 5.
Figure 7:
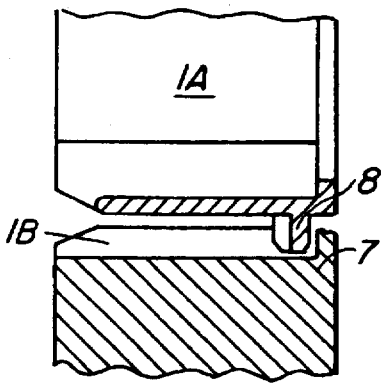
FIG. 7 is a section along the line VII—VII in FIG. 5.

While the tongues 6 are molded onto the base of the laterally open chambers 1B and 1D and engage through slits 7 of chamber walls 4A and 4C in the embodiment shown in FIGS. 2 and 3, in the embodiment of FIGS. 5, 6 and 7, the tongues 6A are made shorter in relation thereto and are overlapped by projections 8. These projections 8 are molded onto the chamber walls 4B or 4C at the base and project beyond the plate edges 2 or 3. In this way, slits 7 are not required on the chamber walls 4A and 4C.

Figure 8:
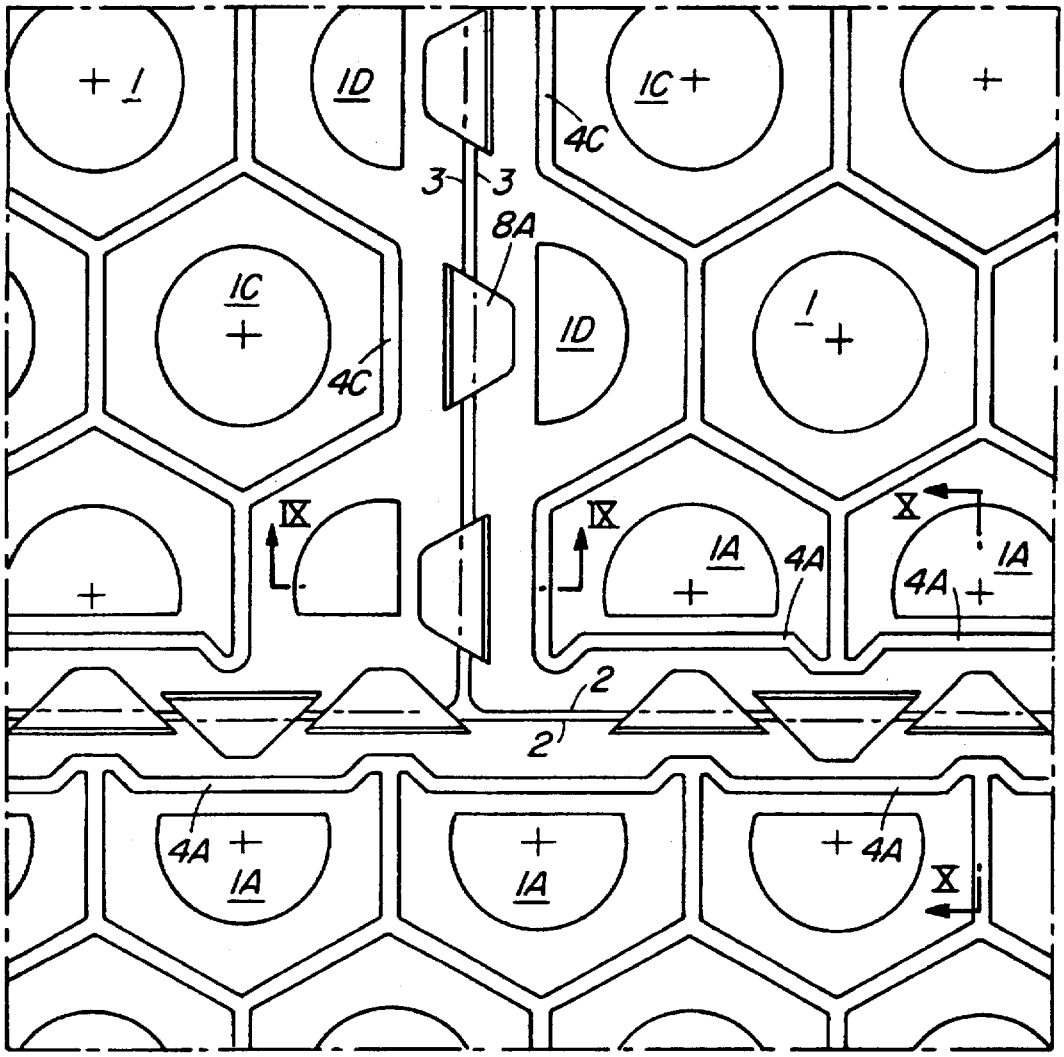
FIG. 8 is a top view corresponding to FIG. 1 in a third embodiment.
Figure 9:
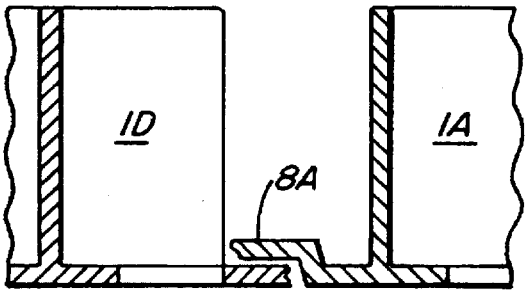
FIG. 9 is a section along the line IX—IX in FIG. 8.
Figure 10:
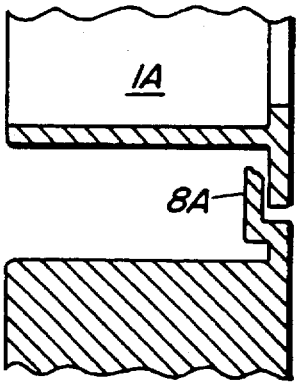
FIG. 10 is a section along the line X—X in FIG. 8.

In the embodiment of FIGS. 8, 9 and 10, peripherally closed chambers 1C alternate with peripherally open chambers 1D along the plate edges 3. The peripherally closed chambers 1C are hexagonal in shape, as chambers 1, while the peripherally open chambers 1D are half as large, seen in cross-section. The plate edges 3 extend at a distance from the peripheral chamber walls 4C, so that a zigzag-shaped channel is formed between adjacent plates along the plate edges 3, the channel extending from the peripherally open chamber 1D of the one plate to the peripherally open chamber 1D of the adjacent plate. Projections 8A, which each extend beyond the edge 3 of the opposite plate, are molded on adjacent to the chamber walls 4C.

A continuous channel is formed along the plate edges 2. The chambers 1A on the plate periphery are each sealed by a chamber wall 4A on the periphery. The plate edges 2 extend at a distance from the chamber walls 4A. In this way, the aforementioned channel is formed between the chamber walls 4A of adjacent plates.

We claim:

1. A honeycomb lawn plate for seeding surfaces comprising peripherally closed chambers having an open top and a hexagonal cross-section, and peripherally open chambers on at least two opposite plate edges, the maximum cross-section of the peripherally open chambers being half as large as the cross-section of the peripherally closed chambers, wherein the peripherally closed chambers are located between peripherally open chambers, the peripheral walls of the peripherally closed chambers are located at a distance from at least one of the opposite plate edges, and the sequence of peripherally closed chambers and peripherally open chambers alternates on the opposite plate edges so that a zigzag channel is obtained between adjacent plates.

2. A honeycomb plate as defined in claim 1 wherein the peripheral walls of the peripherally closed chambers are located at a distance from both of the opposite plate edges.

3. A honeycomb plate as defined in claim 1 further including stepped projections attached adjacent the peripherally closed chambers which extend beyond at least one of the opposite plate edges and above an edge of an adjacent plate.

4. A honeycomb plate as defined in claim 2 further including stepped projections attached adjacent the peripherally closed chambers which extend beyond at least one of the opposite plate edges and above an edge of an adjacent plate.

* * * * *